US009380860B1

(12) United States Patent
Taylor

(10) Patent No.: US 9,380,860 B1
(45) Date of Patent: Jul. 5, 2016

(54) COSMETIC BRUSH CLEANING APPARATUS

(71) Applicant: Fierra Taylor, Dallas, TX (US)

(72) Inventor: Fierra Taylor, Dallas, TX (US)

(73) Assignee: Lilumia International Ltd. (IE)

( * ) Notice: Subject to any disclaimer, the term of this patent is extended or adjusted under 35 U.S.C. 154(b) by 0 days.

(21) Appl. No.: 14/691,575

(22) Filed: Apr. 21, 2015

Related U.S. Application Data

(60) Provisional application No. 62/003,217, filed on May 27, 2014.

(51) Int. Cl.
*A46B 17/06* (2006.01)
*A46B 13/00* (2006.01)
*A46B 13/04* (2006.01)

(52) U.S. Cl.
CPC ..... *A46B 17/06* (2013.01); *A46B 13/008* (2013.01); *A46B 13/04* (2013.01)

(58) Field of Classification Search
CPC ..... A46B 17/06; A46B 17/065; A46B 13/02; A46B 13/001; A45D 24/46; B44D 3/006; A47L 15/30
See application file for complete search history.

(56) References Cited

U.S. PATENT DOCUMENTS

| | | | | |
|---|---|---|---|---|
| 586,404 | A * | 7/1897 | Tyler et al. | 68/63 |
| 2,822,814 | A * | 2/1958 | Torkelson | 134/135 |
| 2,853,085 | A | 9/1958 | Torkelson | |
| 2,994,330 | A | 8/1961 | Catlin et al. | |
| 3,129,451 | A | 4/1964 | Colaianni | |
| 3,225,377 | A | 12/1965 | Winter et al. | |
| 3,805,318 | A | 4/1974 | Marquette | |
| 3,982,296 | A | 9/1976 | Russo | |
| 5,107,877 | A | 4/1992 | Chipman | |
| 5,652,991 | A | 8/1997 | Kashani | |
| 5,701,626 | A | 12/1997 | Zara et al. | |
| 5,881,876 | A | 3/1999 | Nonomura et al. | |
| 6,935,515 | B1 * | 8/2005 | Sookoo | 211/65 |
| D513,948 | S * | 1/2006 | Martin | D7/600.4 |
| D516,257 | S | 2/2006 | Brackett et al. | |
| 7,086,112 | B2 | 8/2006 | Smith et al. | |
| 7,458,944 | B2 | 12/2008 | Liste et al. | |
| 7,594,291 | B1 | 9/2009 | Carmen | |
| 2004/0181887 | A1 | 9/2004 | Smith et al. | |
| 2011/0232681 | A1 | 9/2011 | Hatfield | |
| 2012/0199168 | A1 * | 8/2012 | Campbell | 134/182 |
| 2013/0000062 | A1 | 1/2013 | Brackett et al. | |
| 2014/0000052 | A1 | 1/2014 | Filho et al. | |
| 2014/0096801 | A1 * | 4/2014 | McCormick et al. | 134/115 R |
| 2014/0189969 | A1 | 7/2014 | Baker et al. | |
| 2015/0060373 | A1 * | 3/2015 | Byeon | 211/1.3 |

* cited by examiner

*Primary Examiner* — Michael Kornakov
*Assistant Examiner* — Natasha Campbell
(74) *Attorney, Agent, or Firm* — Law Office of Sam Sokhansanj PLLC

(57) ABSTRACT

A cosmetic brush cleaner apparatus is provided for automatically washing, cleaning, rinsing, and sanitizing a plurality of cosmetic brushes quickly, efficiently, and effectively. In particular, the cosmetic brush cleaner includes a removable lid, a base having a liquid inlet port, a removable brush holder coupled to the base, wherein the brush holder secures one or more cosmetic brushes. The cleaner further comprises a bristle plate coupled to the base, a liquid dispensing port for dispensing the liquid on to the bristle plate, a liquid drainage port for draining the liquid from the bristle plate, wherein the bristle plate is configured to engage the cosmetic brushes, and a controller for operating a motor of the brush cleaner.

12 Claims, 11 Drawing Sheets

COSMETIC BRUSH CLEANING APPARATUS

CROSS-REFERENCE TO RELATED APPLICATION

This application claims the benefit of U.S. Provisional Application No. 62/003,217 filed on May 27, 2014, which is incorporated herein by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Cosmetic or makeup brushes are one of the most common tools used to apply makeup and various cosmetic products. However, after a period of use, the brush's bristles tend to accumulate large amounts of residue from the cosmetic products, and can make applying makeup less effective. Hence, a user is generally required to continually clean the brushes to not only remove the residue build up on the bristles but to also prolong the life of bristles and promote better hygiene. For example, in professional settings, a cosmetologist will typically need to clean the brushes after each cosmetic or makeup application for hygienic purposes and preventing contamination. Currently there are a number of solutions for cleaning makeup or cosmetic brushes. Some of these solutions attempt to only sell cleaning solutions, but these solutions fail to meet the needs of the market because using the solutions by themselves and rinsing each individual brush by hand can be a time consuming, tedious, and laborious task.

Hence, what is needed is an automated cosmetic brush cleaning device that can effectively, efficiently, and quickly clean, wash, and sanitize multiple cosmetic brushes at any time.

BRIEF SUMMARY

One or more aspects of the present disclosure described herein overcome the above shortfalls of prior attempted methods, devices. In particular, in one aspect of the disclosure described herein, a cosmetic brush cleaning apparatus is disclosed that can automatically wash, clean, rinse, and sanitize a plurality of cosmetic brushes quickly, efficiently, and effectively. In particular, a cosmetic brush cleaner apparatus is provided having a base, a brush holder coupled to the base, wherein the brush holder secures one or more cosmetic brushes having bristles. Further, the brush cleaner includes a cleaning member having a textured, bristle, abrasive, or brushing surface, wherein the cleaning member is coupled to the base. In addition, the cleaning member is configured to engage the bristles of the cosmetic brushes. Also, the brush holder can include a first plate and a second plate. Here, the first and second plates can further include a plurality of cosmetic brush securement members. The securement members can include flexible openings that are configured to secure the cosmetic brushes. In addition, the base can further include a fluid basin having a first compartment and a second compartment. Here, the first compartment can receive fresh fluid and the second compartment can receive disposal or waste fluid. Further, the brush holder can at least partially rotate with respect to the cleaning member. Specifically, the brush holder can be configured to rotate or pivot in a back and forth operation. Also, the brush cleaner can further include a user interface controlling operation of the brush cleaner.

In another aspect of the disclosure described herein, a cosmetic brush cleaner apparatus is provided having a removable lid, a base having a liquid inlet port, and a removable brush holder coupled to the base, wherein the brush holder secures one or more cosmetic brushes. In addition, the brush cleaner can further include a removable bristle plate coupled to the base, a liquid dispensing port for dispensing the liquid on to the bristle plate, and a liquid drainage port for draining the liquid from the bristle plate, wherein the bristle plate is configured to engage the cosmetic brushes. In addition, an electronic controller can be provided for operating a motor of the brush cleaner. Here, the brush holder can be further coupled to a drive shaft for operating the brush holder via the motor. In addition, the brush holder can be further configured to at least partially rotate in a clockwise and counter-clockwise operation. The brush holder can further include a plurality of securement devices for securing a cosmetic brush. Further, a first securement device can secures a tail region of a cosmetic brush, and a second securement device secures a head region of the cosmetic brush.

In another aspect of the disclosure described herein, a method of cleaning cosmetic brushes is provided. The method can include receiving one or more cosmetic brushes in a brush holder of a cosmetic brush cleaner apparatus, wherein the brush holder includes a plurality of securement members. The method can further include engaging the bristles of the cosmetic brushes via a cleaning member, receiving liquid within a liquid compartment of the brush cleaner apparatus, receiving a cleaning cycle command from a controller, and operating the cleaning cycle, wherein the liquid is dispensed onto the cleaning member and a motor operates to at least partially rotate the brush holder or the brushing surface. In addition, the operating can further include draining the liquid from the brushing surface. Here, the cleaning cycle can further include a rinse cycle and a wash cycle. In addition, the method can further include outputting a notification via a user interface. Here, wherein the notification can include one or more of visual, light, color, video, audible, and haptic feedback.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which:

FIG. 9B illustrates a perspective close-up view of the liquid dispenser port and drainage ports in relation to their corresponding components in FIG. 9A.

DETAILED DESCRIPTION

In the Brief Summary of the present disclosure above and in the Detailed Description of the Disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
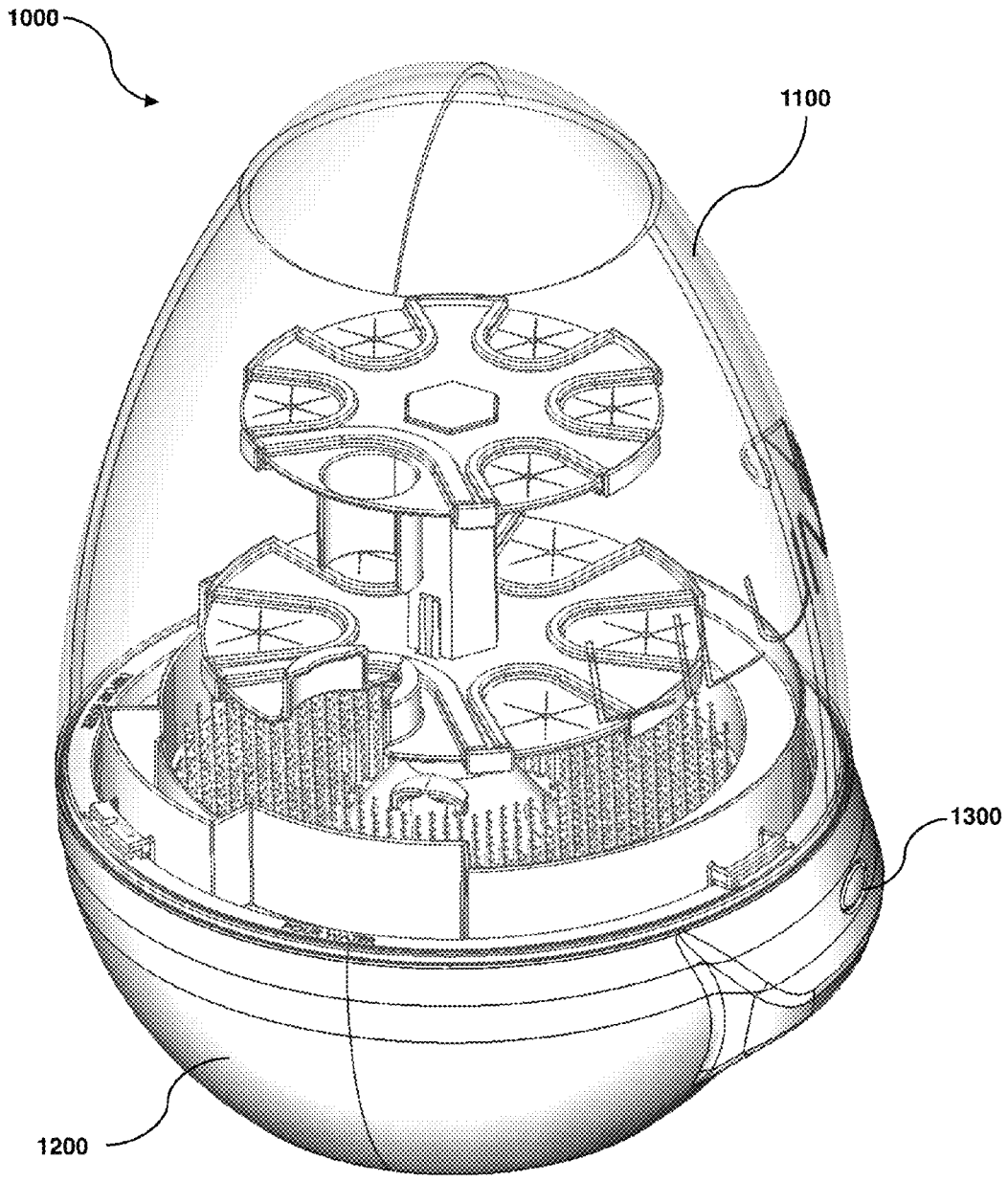
FIG. 1 illustrates a perspective left-top side view of one non-limiting embodiment of the cosmetic brush cleaner apparatus of the disclosure described herein, illustrated with its top lid cover.
Figure 2:
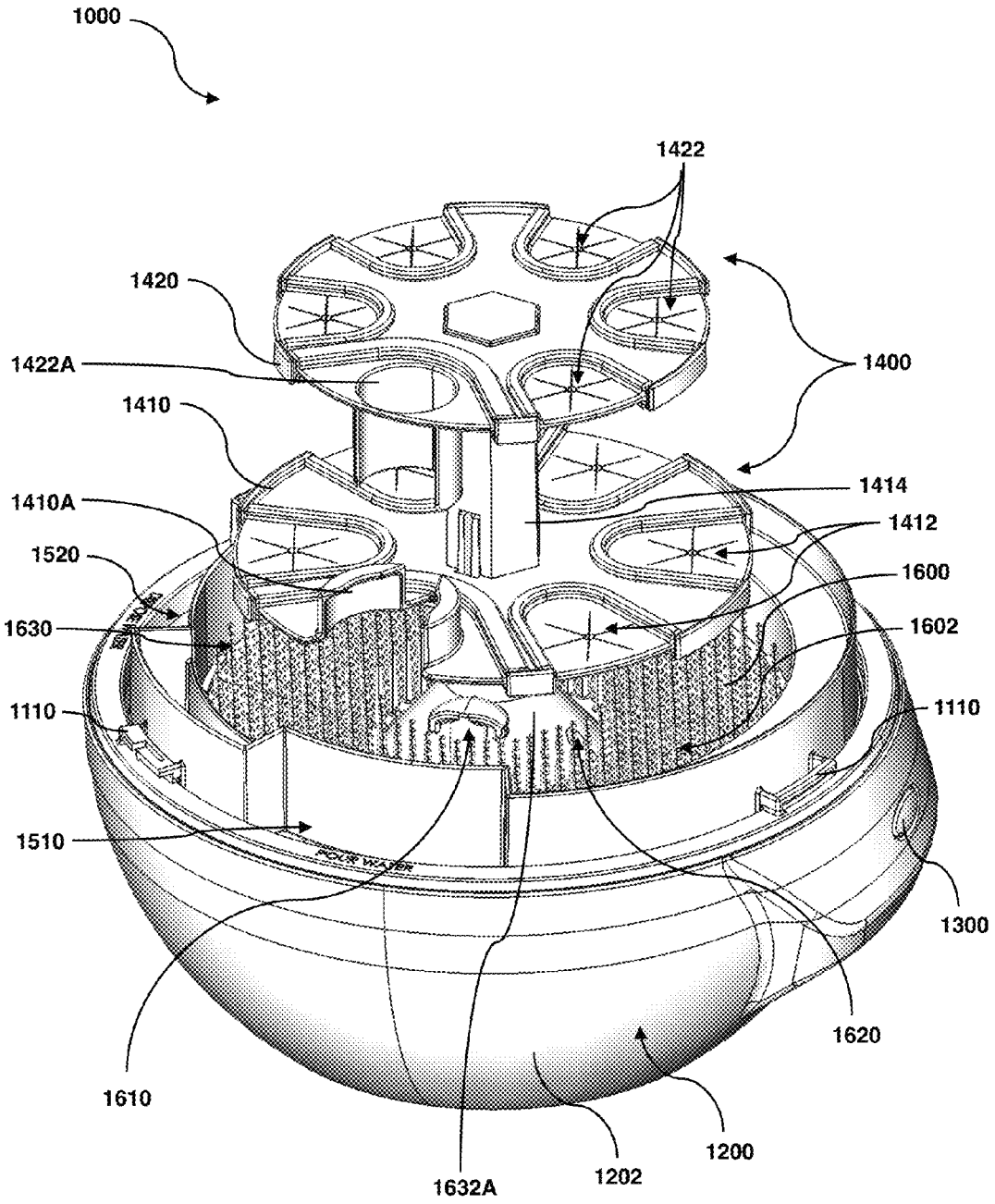
FIG. 2 illustrates a perspective left-top side view of the cosmetic brush cleaner apparatus of the disclosure described herein, illustrated with its top lid cover removed.
Figure 3A:
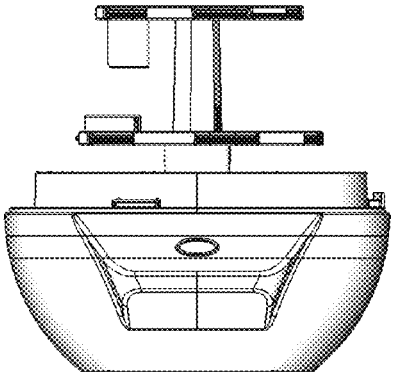
FIG. 3A illustrates a front view of the cosmetic brush cleaner apparatus of the disclosure described herein, illustrated with its top lid cover removed.
Figure 3D:
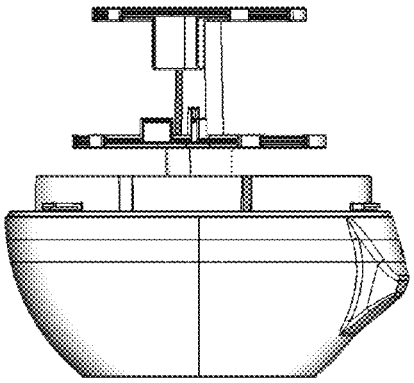
FIG. 3D illustrates a left side view of the cosmetic brush cleaner apparatus of the disclosure described herein, illustrated with its top lid cover removed.
Figure 3B:
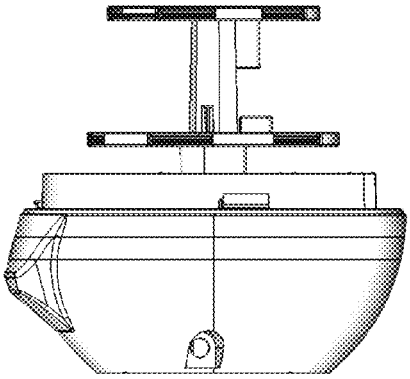
FIG. 3B illustrates a right side view of the cosmetic brush cleaner apparatus of the disclosure described herein, illustrated with its top lid cover removed.
Figure 3E:
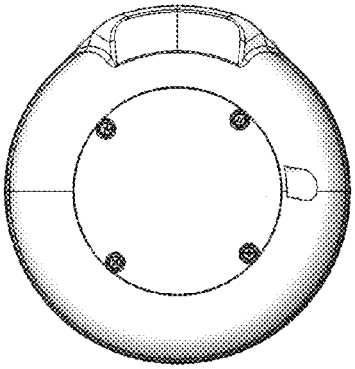
FIG. 3E illustrates a bottom view of the cosmetic brush cleaner apparatus of the disclosure described herein, illustrated with its top lid cover removed.
Figure 3C:
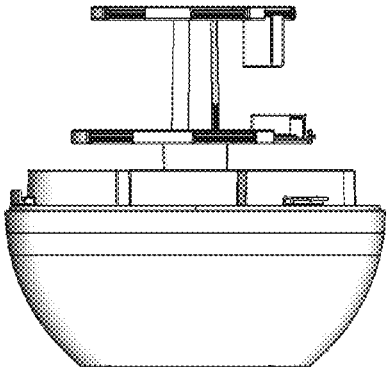
FIG. 3C illustrates a rear view of the cosmetic brush cleaner apparatus of the disclosure described herein, illustrated with its top lid cover removed.
Figure 3F:
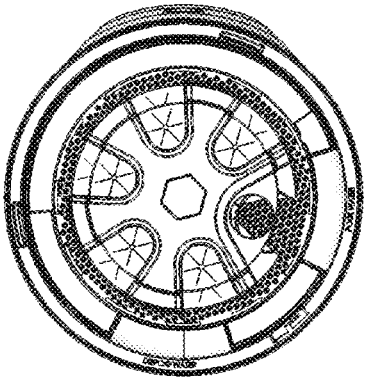
FIG. 3F illustrates a top view of the cosmetic brush cleaner apparatus of the disclosure described herein, illustrated with its top lid cover removed.
Figure 11:
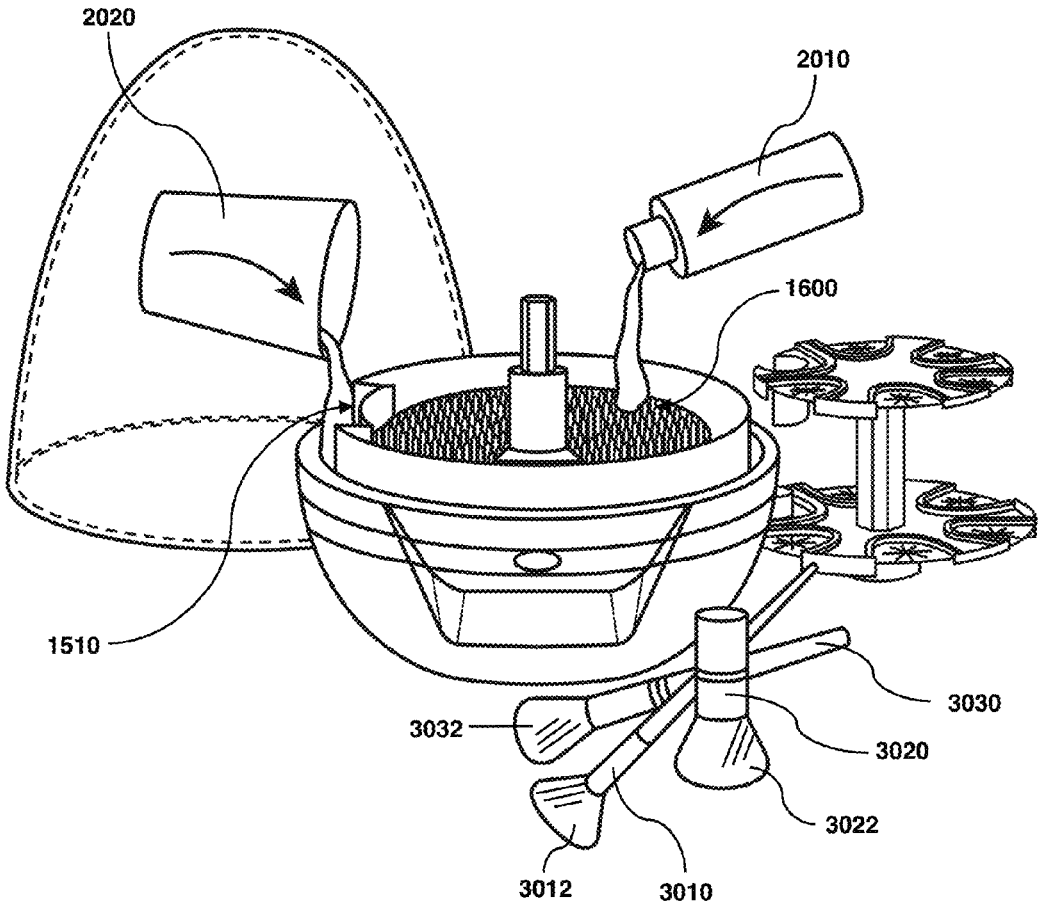
FIG. 11 illustrates a perspective simplified view of the brush cleaner apparatus, illustrating a method of pouring fresh liquid, such as water, into the liquid basin of the apparatus, and pouring a cleaning solution onto the washing area or bristle plate.
Figure 12:
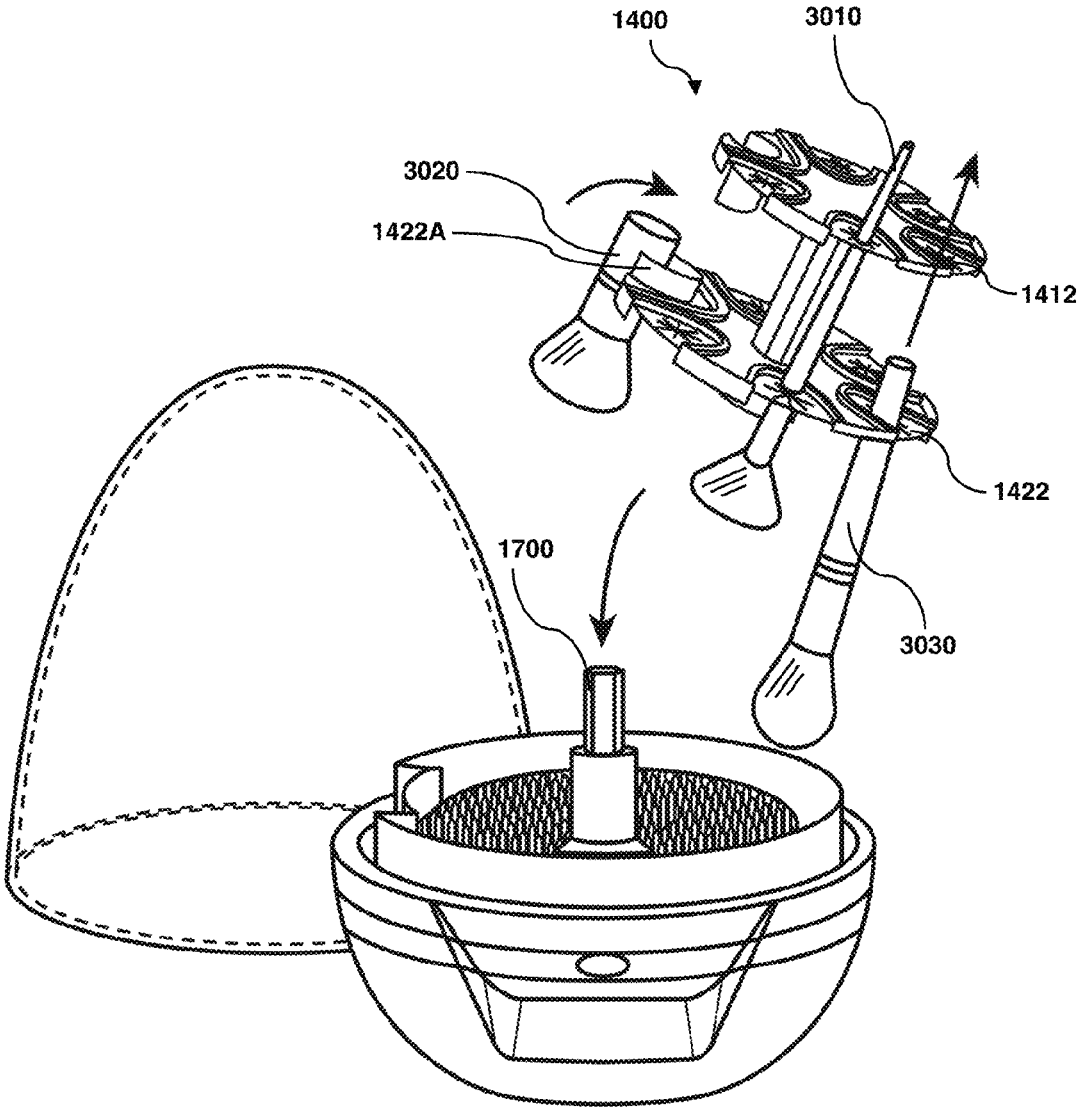
FIG. 12 illustrates a perspective simplified view of the brush cleaner apparatus, further illustrating a method of loading brushes onto the stand and inserting the stand onto the draft shaft of the apparatus prior to commencing the cleaning cycle.

Referring to FIG. 1, the brush cleaner apparatus 1000 of the disclosure described herein is shown having a top lid cover 1100, base 1200, and controller and display interface 1300. Referring now to FIG. 2, brush cleaner 1000 further includes a brush holding carousel or stand 1400 comprised of a two-tier brush retention holder. More specifically, a bottom tier brush holder or plate 1410 is connected to pillar 1414 that further connects to a top tier brush holder or plate 1420, wherein pillar 1414 secures holder 1410 and 1420. Here, holder 1410 further includes a plurality of openings or securement members 1412, and holder 1420 further includes a plurality of openings or securement members 1422. More specifically, retention or securement members 1412 and 1422 are comprised of a rubber-like material having perforated or cut rubber cross-hair openings or slots for securely gripping (via friction) the handle portion of the brushes. Here, as the brush handle is slid through the cross-hair openings of the retention members, the cut rubber parts of the openings can slightly protrude outwards or inwards, thereby securely gripping the outer perimeter of the brush handle. More particularly, the top retention members 1422 secure the lower or end region of the brush handle and bottom retention members 1412 secure the head or top region of the brush handle, as further illustrated in FIG. 11-12. In the current embodiment of the securement members 1412 and 1422, one or more of them can have a slightly larger securement member, such as 1412A and 1422A, respectively, for accommodating larger circumference brush handles, as further illustrated in FIG. 11-12. In the current embodiment, each of holders 1410 and 1420 include six (6) securement members, wherein the stand 1400 can accommodate up to six (6) brushes at any given time for a cleaning cycle. However, it is contemplated within the scope of the disclosure described herein that stand 1400, or the cleaner apparatus 1000 in general, may also be configured to accommodate from one (1) up to five-hundred (500) brushes for each cleaning cycle. For example, there may also be a smaller travel size variant of brush cleaner 1000.

Still referring to FIG. 2, brush cleaner 1000 includes a washing area 1630 having a cleaning member, bristle plate, or bristle disc 1600 disposed therein, wherein plate or disc 1600 includes a plurality of bristles 1602. Bristle disc 1600 and bristles 1602 can be comprised of any flexible or rigid plastic or rubber material. Here, bristles 1602 are configured to engage the brush head, more specifically the bristles of the brush, as further illustrated in FIG. 13-14. Here, in the current embodiment, the bristles 1602 operate to agitate, disperse, wash, and thoroughly clean the brush bristles from residue via a back and forth rotating step operation of stand 1400 with respect to bristle disc 1600, wherein the disc is fixed in position, as further illustrated in FIG. 13-14. Alternatively, in another embodiment, disc 1600 may be configured to rotate or oscillate with respect to a fixed brush stand. In other embodiments, both stand 1400 and disc 1600 may be configured to rotate, such as in opposing directions. In the current embodiment, the density of the bristles 1602 is approximately 36 bristles per square inch, however, it is contemplated within the scope of the disclosure described herein that any other densities may also be used. Further, it is contemplated within the scope of the disclosure described herein that disc 1600 and bristles 1602 may also have any texture and be made of any type of material, including but not limited to sponge, polyester, brushing bristles, wires, metallic, cotton, or any combination thereof.

Figure 7:
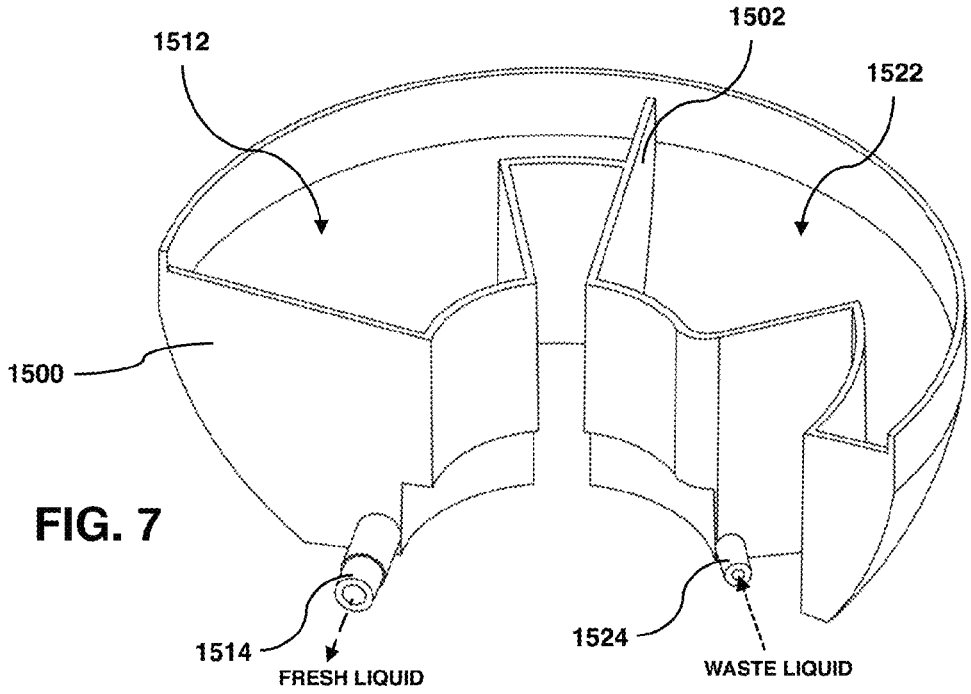
FIG. 7 illustrates a perspective view of a liquid basin for the brush cleaner apparatus.

Still referring to FIG. 2, brush cleaner 1000 includes an inlet port 1510 for receiving clean, fresh, or recycled liquid or water for commencing a cleaning cycle. Further, an outlet port 1520 is also provided for disposing the waste or disposal liquid at the end of a cleaning cycle. Here, port 1510 corresponds to chamber 1512 (FIG. 7) and port 1520 corresponds to chamber 1522 (FIG. 7). In addition, brush cleaner 1000 includes a liquid dispenser port 1610 for dispensing the fresh liquid onto the bristle disc 1600 within area 1630 during a cleaning cycle, and a drainage port 1620 for draining the liquid (waste liquid) from the bristle disc 1600 or washing area 1630, which will later be described in more detail within the disclosure. Here, washing area 1630 is configured as a container or receptacle for retaining and holding the liquid during cleaning cycle. FIGS. 3A-3F illustrate various views for the cleaner 1000, further illustrating the stand 1400, holders 1410 and 1420, securement members 1412 and 1422, base 1200, and disc 1600, among others.

Figure 4:
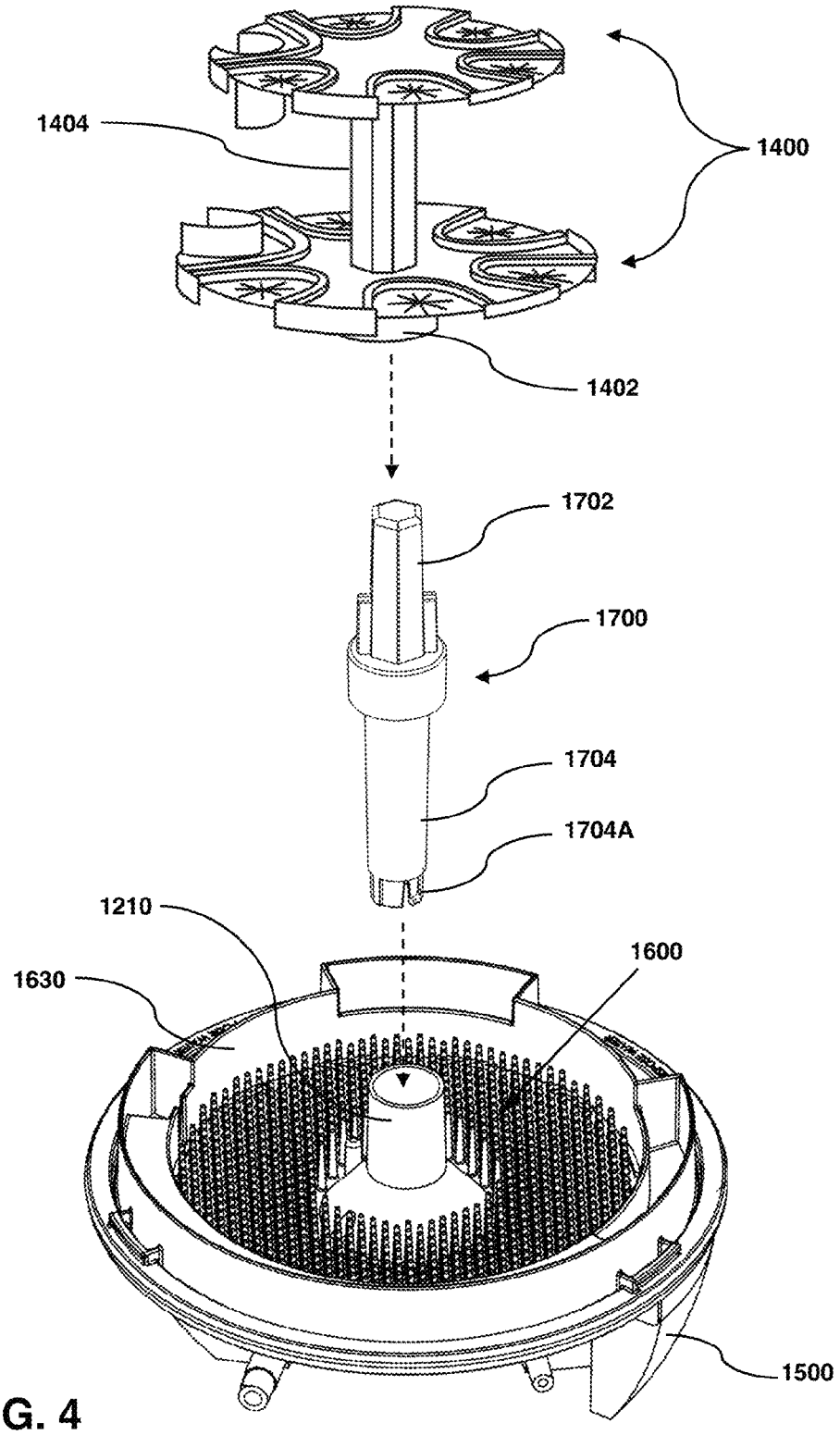
FIG. 4 illustrates a perspective exploded view of a brush stand and drive shaft being coupled to a drive shaft receiving member of the brush cleaner apparatus, among others.

FIG. 4 illustrates an exploded view of stand or brush holder 1400, drive shaft 1700, the of at least a portion of base 1200 and having a drive shaft receiving female member 1210. More specifically, stand 1400 includes at least a hollow pillar 1410 for receiving the male top end head portion 1702 of drive shaft 1700. Here, the interior of member 1402 is configured to align with the exterior of top end portion 1702, and more specifically, the interior of member 1402 has a hexagon configuration that securely engages the hexagon configuration of portion 1702, wherein the drive shaft 1700 can rotate or pivot the top and bottom holders of stand 1400 via their connection or attachment to pillar 1410. Further, the lower end male portion 1704 is further placed and secured within female drive shaft receiving member 1210, wherein the distal end 1704A engages a cam or gear member that is further coupled to a step motor, further rotating the drive shaft in a clockwise and counter-clockwise step rotating operation.

Figure 5:
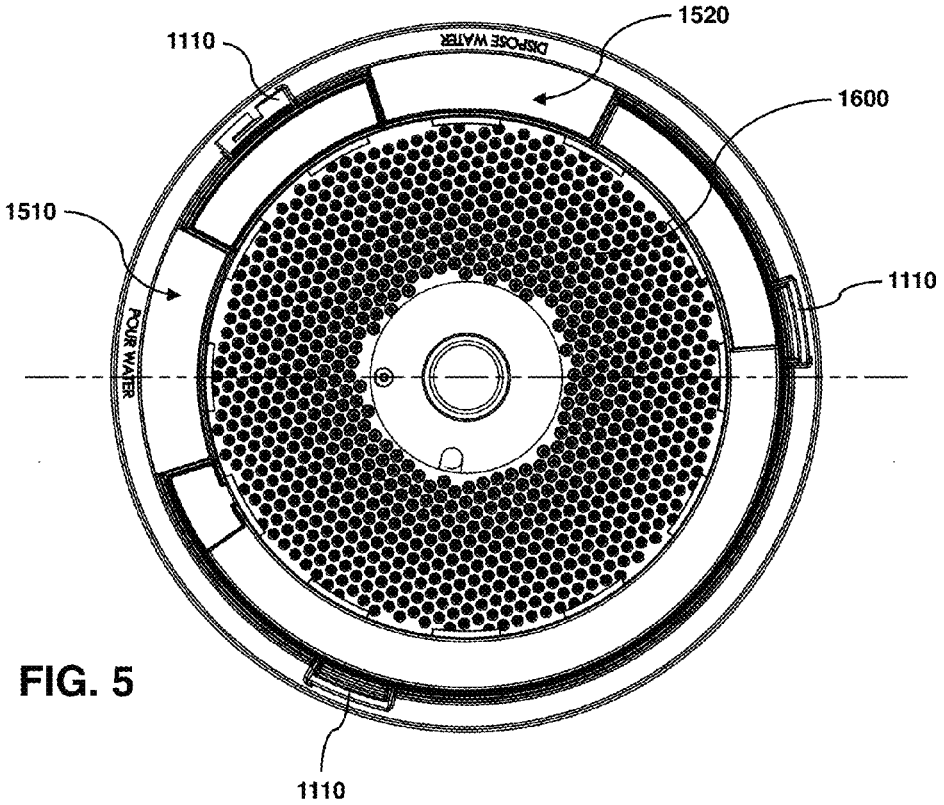
FIG. 5 illustrates a top view of a washing area, inlet and outlet liquid ports, and bristle plate of the apparatus, among others.
Figure 6:
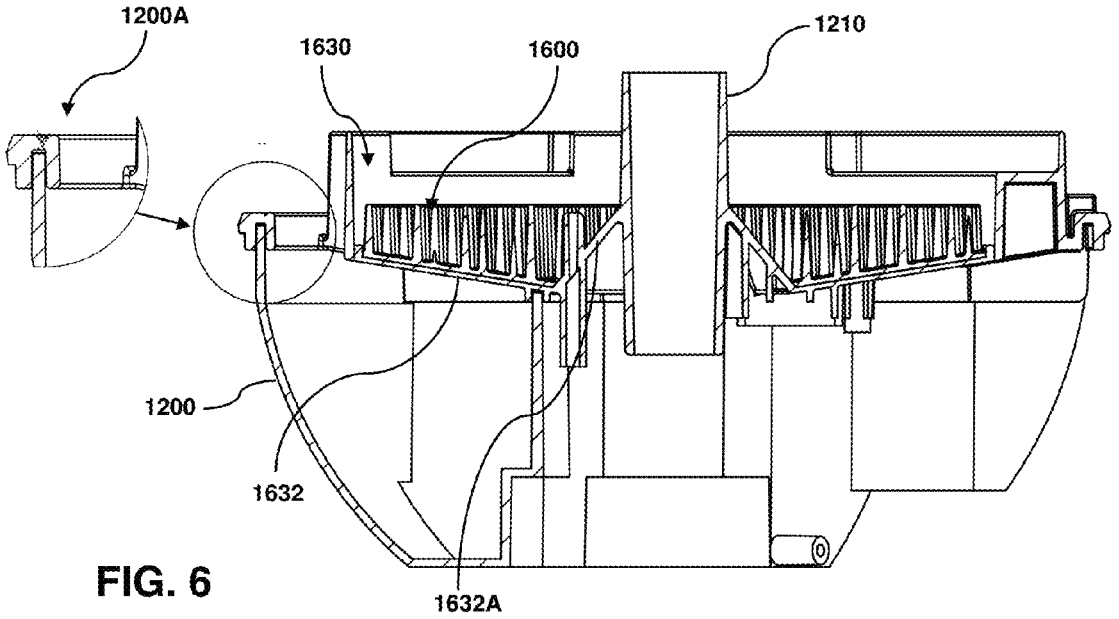
FIG. 6 illustrates cross-sectional side view of FIG. 5.

FIG. 5 and FIG. 6 illustrate a top view and cross-section view of at least a partial view of the washing area 1630 and base 1200, with the bottom shell 1202 removed. More specifically, washing area 1630 includes the bristle disc 1600, wherein the bottom floor 1632 of the washing area 1630 is shown angled downwards and then angled upwards thereby forming an elevated dome shaped base 1632A, wherein an upper region of the dome 1632A can include the liquid dispensing port 1610 and a lower region can include the liquid drainage port 1620. For example, the elevated dome shape 1632A can prevent the liquid within area 1630 from entering dispensing port 1610 and member 1210. In addition, the floor of the dome can allow for proper drainage of the liquid via drainage port 1620. Further, a close-up cross-sectional view 1200A is provided to illustrate the waterproof seal between the base 1200 and the tray that holds the washing area 1630, among others.

Figure 8:
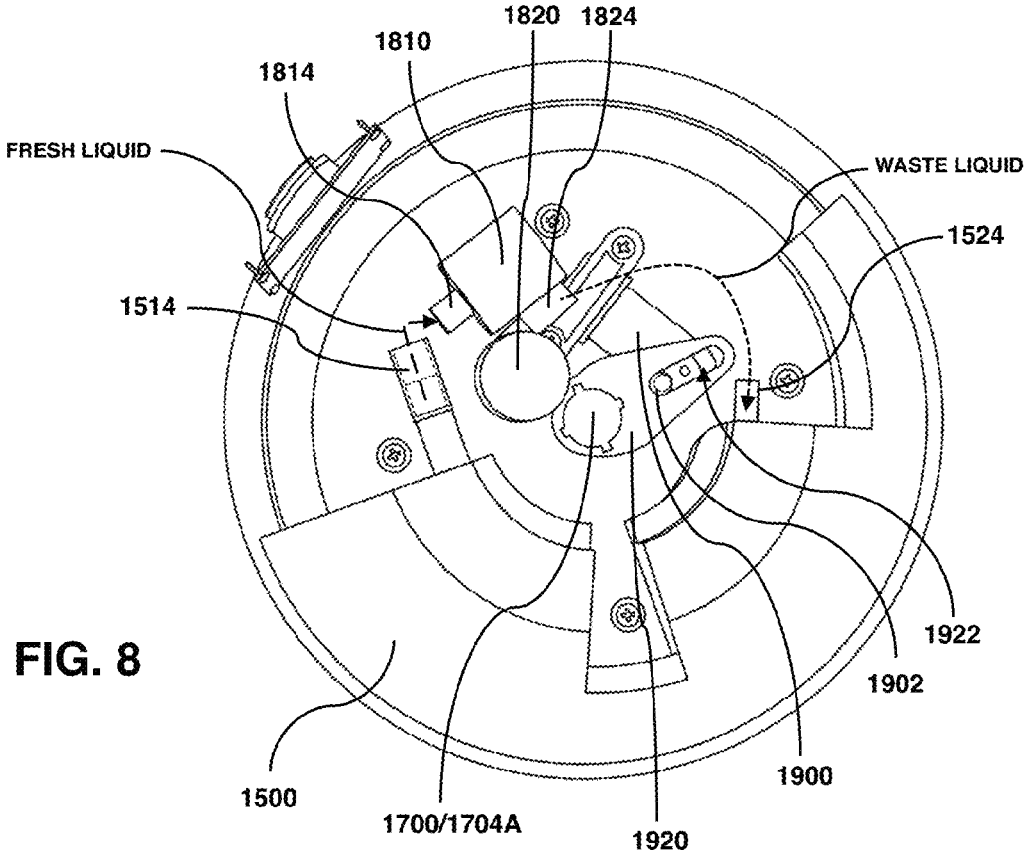
FIG. 8 illustrates bottom view of the brush cleaner apparatus, with a bottom base shell removed, thereby at least partially illustrating the liquid basin, pump motors, step motor, draft shaft of the brush cleaner apparatus, among others.
Figure 9A:
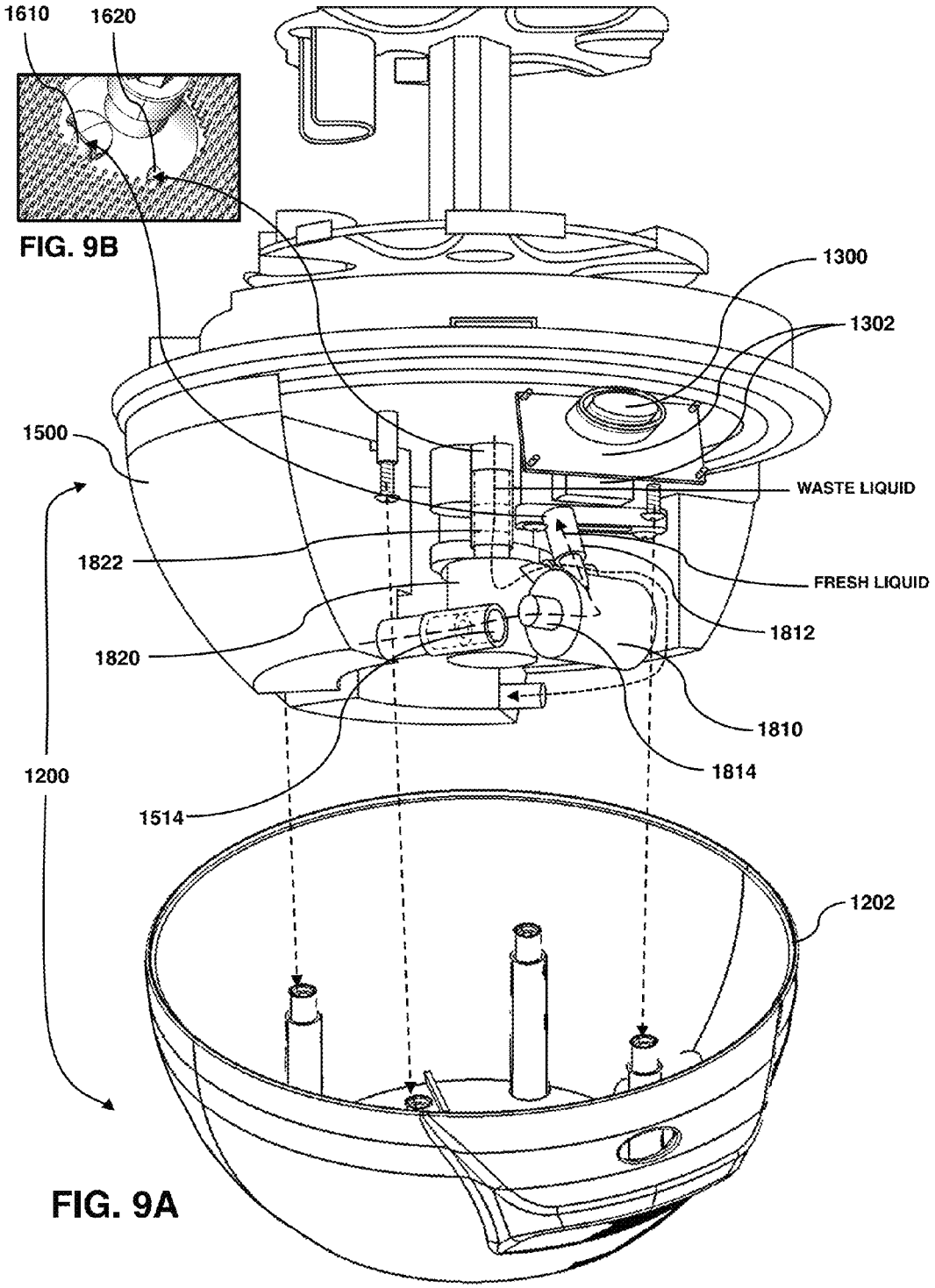
FIG. 9A illustrates a perspective exploded view of the base portion, wherein the bottom base shell is removed, thereby at least partially illustrating the liquid basin, pump motors, step motor, draft shaft of the brush cleaner apparatus, among others.
Figure 10:
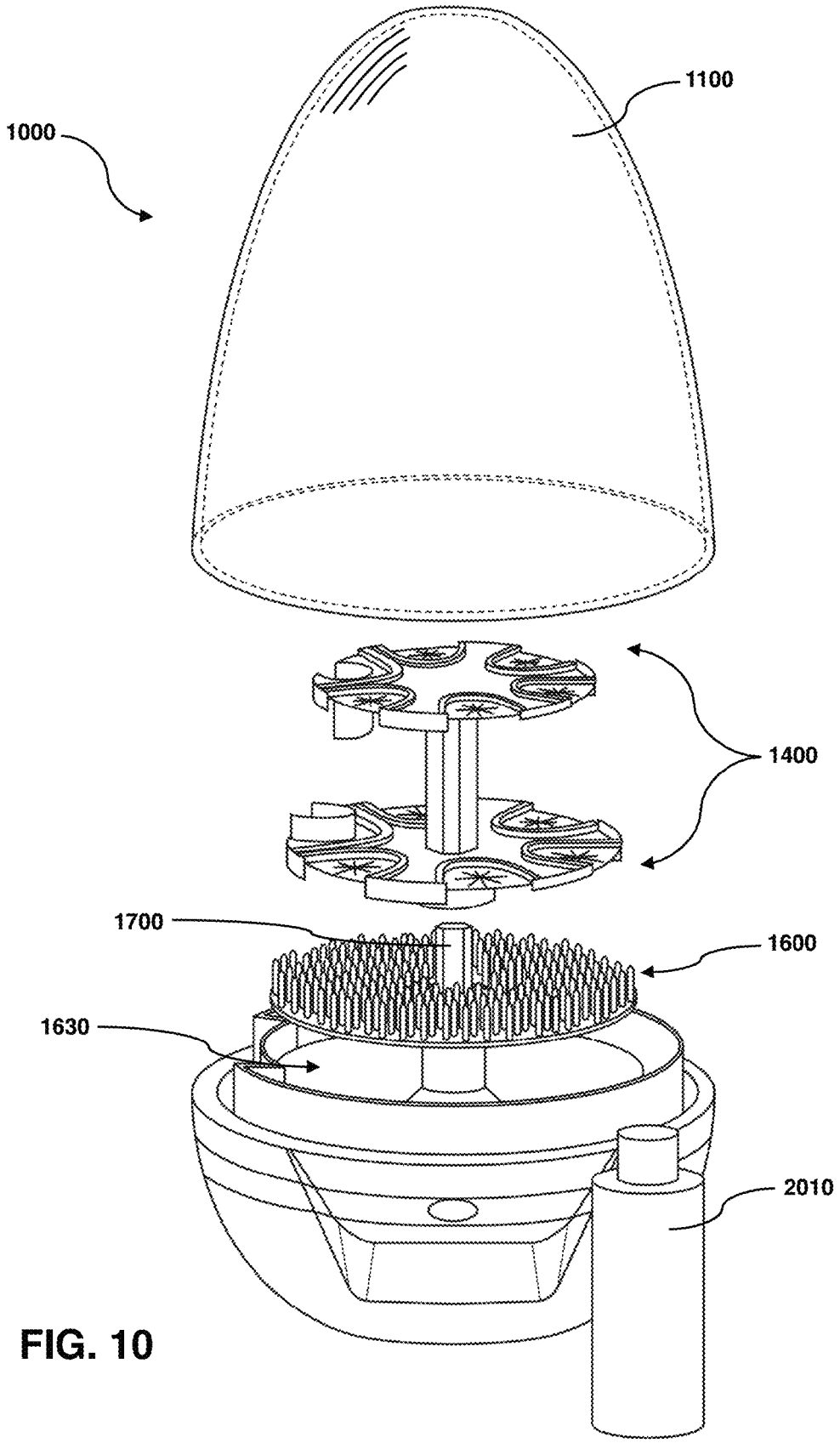
FIG. 10 illustrates a perspective exploded simplified view of the brush cleaner apparatus, illustrating a method of removing the top lid cover, stand, and bristle plate, in preparation for a cleaning cycle or cleaning of the bristle plate.

Referring now to FIGS. 7, 8, 9A, and 9B, various components and method of operation of the brush cleaner apparatus 1000 will be described. Generally, FIG. 7 illustrates a perspective view of the liquid container basin 1500, wherein the basin 1500 is compartmentalized via divider 1502 into two separate chambers, chamber 1512 and chamber 1522. FIG. 8 illustrates a bottom view and FIG. 9A illustrates a perspective bottom view of the brush cleaner apparatus, with the bottom base shell 1202 removed, thereby at least partially illustrating the liquid basin 1500, pump motors 1810 and 1820, step motor 1900, and drive shaft 1700 of the brush cleaner apparatus, among other components which will be described in more detail. More specifically, chamber 1512 is configured to hold and retain a fresh or cleaning liquid or water to be used in the cleaning cycle of brush cleaner 1000, and chamber 1520 is configured to hold and retain the disposal or waste liquid during and after the cleaning cycle. More specifically, during a cleaning cycle operation, outlet 1514 allows the fresh liquid to be pumped out to pump 1810, via the pumps inlet 1814. The pump 1810 then feeds the fresh liquid to the washing area 1630 and bristle disc 1600 via the pump's outlet 1812 (FIG. 9A) which is connected to liquid dispenser outlet port 1610 (FIG. 9B). Further, during the cleaning cycle operation, drainage inlet port 1620 (FIG. 9B) allows liquid within the washing area 1630, which is accumulated with residue from the cleaning cycle (disposal or waste liquid), to be pumped out to pump 1820 via the pump's inlet 1822, and then pumped out via the pump's outlet 1824 to the liquid disposal chamber 1522 via the chamber's inlet port 1524. For illustrative purpose, the tubular connector or hoses are omitted from the FIGS. 7, 8, and 9A that connect outlet 1514 to inlet 1814, and that connect outlet 1824 to inlet 1524.

Figure 13:
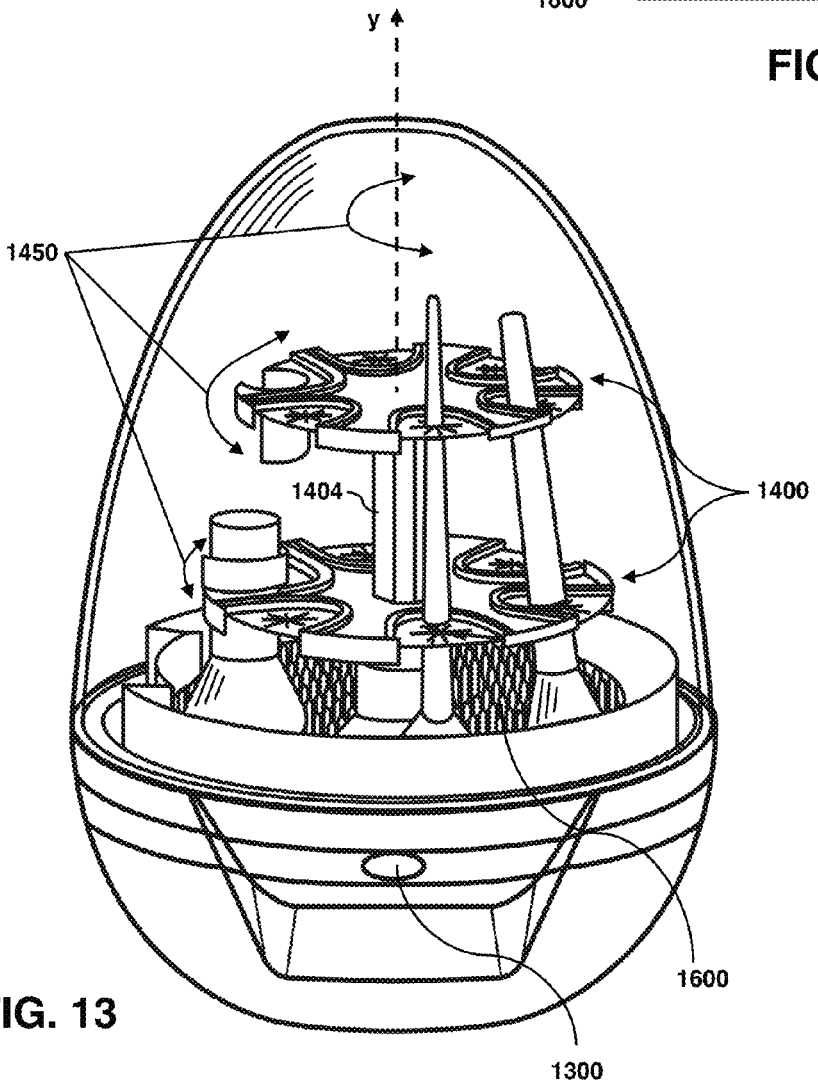
FIG. 13 illustrates a perspective simplified view of the brush cleaner apparatus, further illustrating a method of operation for the apparatus, wherein the brushes and stand are loaded and the top lid cover is placed thereon, and further illustrating the back-forth rotation direction of the stand about a vertical axis during a cleaning cycle.

Still referring to FIGS. 8 and 9A, the brush cleaner apparatus 1000 is further shown having a stepper motor 1900. Here, motor 1900 is further coupled to projecting pin 1902 that is disposed within slot 1922 of a cam or shaft 1920. During a cleaning cycle, motor 1900 operates to rotate pin 1902 in a controlled back and forth or clockwise and counter-clockwise manner thereby further rotating shaft 1920 in a clockwise and counter-clockwise manner that further rotates shaft 1700 in a clockwise and counter-clockwise manner. More specifically, one end of the shaft 1920 is connected to the bottom end 1704A of drive shaft 1700, thereby fully engaging shaft 1700. Here, in the current embodiment, it is noted that shaft 1700 does not make a complete or fully 360-degree revolution, but it makes partial revolutions, such as from a 5-degree to 270-degree, preferably 30 degrees, in a back and forth or clock-wise or counter-clockwise revolutions, as also illustrated in one embodiment for the method of operation in FIG. 13, illustrating the stand 1400 moving in a back-forth direction 1450 about an axis, with respect to fixed bristle disc 1600. However, it is contemplated with the scope of the disclosure described herein that the motor 1900 may also rotate and spin in a continuous manner, such as making complete 360 degrees revolutions in a continuous operation, and further rotating shaft 1700 and stand 1400 in a continuously spinning operation making full revolutions.

Referring now to FIGS. 10-13, one or more methods of operation of the cosmetic brush cleaning apparatus 1000 will now be described. In one embodiment, prior to beginning a cleaning cycle, the top lid cover 1100 can be removed by a user from the base 1200 by slightly rotating the lid and disengaging/unlocking the lid from the side locking tabs 1110 (FIGS. 1-2) of the base 1200, wherein tabs 1110 are not shown in FIG. 10-13 for illustrative purposes. Next, stand 1400 can be removed by pulling it out of the drive shaft 1700. Further, if the bristle disc 1600 also needs to be rinsed or cleaned, it can be also be removed from the washing area 1630. At anytime, if there is waste liquid or disposal liquid within basin 1500 from a prior cleaning cycle, the waste liquid can be disposed of via the liquid disposal outlet port 1520 (FIG. 2, 5), which is not shown in FIG. 10-13 for illustrative purposes. Here, the waste liquid can be disposed via port 1520 by tilting the device 1000 or base 1200 to its side and pouring out the waste liquid and the contents out of chamber 1522, such as into a sink. It other embodiments, the liquid basin 1500, such as disposal chamber 1522 may be removable in order to dispose of the waste liquid.

Figure 14:
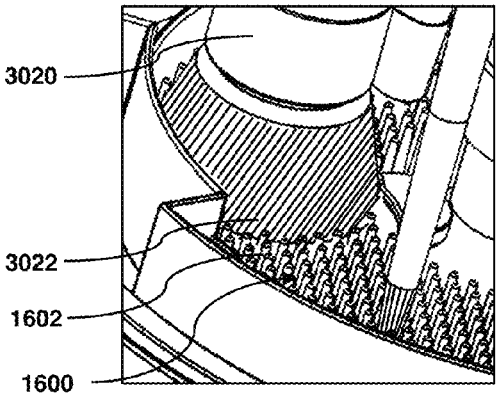
FIG. 14 illustrates a perspective close-up view for one embodiment of the brush bristles engaging the bristles of the bristle plate, wherein the back and forth operation of the brushes (via the stand) against the bristle plate agitates the brush bristles, liquid, and cleaning solution, thereby washing and cleaning the brush bristles.

Still referring to FIGS. 10-13, once stand 1400 is removed, fresh or clean liquid 2020, such as fresh water, can be poured into basin 1500 within base 1200, via inlet opening port 1510 (FIG. 2, 5) and subsequently into chamber 1512 (FIG. 7). Next, a liquid or powdered cleaning solution 2010 can be poured onto the washing area 1630 and bristle disc 1600. Alternatively, the cleaning solution 2010 and fresh liquid 2020 can both be poured into opening port 1510 and chamber 1512. In other embodiments, a cleaning solution 2010 can be solely used as the clean or fresh liquid to be poured into chamber 1512, without requiring additional liquid 2020. Here, cleaning solution 2010 can be any soap, detergent, lathering, sanitizing, disinfecting, or anti-bacterial composition. Next, brushes 3010, 3020, and 3030 can be loaded onto the stand 1400. More specifically, the brushes are inserted through the openings of the securing devices 1412 and 1422, as previously discussed within this disclosure with respect to FIG. 2. Once the brushes are loaded, the stand is then placed back on to the drive shaft 1700, thereby fully engaging the drive shaft. Referring to FIG. 13, once the stand is placed back on the apparatus, the user can check to see if the brush head bristles 3022 are in full contact and engaged with bristles 1602 of bristle disc 1600 to allow for proper cleaning of the brush bristles. Here, FIG. 14 illustrates the contact or engagement of the cosmetic brush bristles 3022 with the bristles 1602 of the bristle disc 1600. Next, the lid 1100 can be placed back on the base 1200, wherein tabs on the lid are positioned to fully engage side lock tabs 1110 (FIG. 1, 2, 5), thereby securing the lid 1100 to the base, wherein the lid helps to contain any splashing of liquid to within. Next, the user can begin the cleaning or wash cycle by pressing button or user interface 1300 of the controller.

Here, user interface 1300 can include any type of controller having an algorithm, application, firmware, hardware, or software for performing one or more cleaning cycles. Here, software, application, and firmware may include any non-transitory computer readable medium storing thereon a program or algorithm, which when executed by a computer, causes the computer to perform a method, process, or function. Further, user interface 1300 can include a graphical video display, LED, LCD, lighting, video, audio, icon, timer, an alert or notification source (such as speaker capable of creating an audible tone, LED or other notification indicator), one or more human interface elements allowing for the selection or editing of settings related to a cleaning cycle, including, but not limited to, a type of cleaning cycle (such as rinse, agitation, or ultrasonic), the length of a cleaning cycle, gentle or hard settings, speed settings, type of brushes to be cleaned, specific settings for each holder of the stand, or any combination thereof.

In one embodiment for a method of operation of the cleaning cycle, the cleaning cycle can include a wash cycle, a first rinse cycle, a second rinse cycle, an optional cycle, and a reset operation. More specifically, the wash cycle can include but is not limited to: (a) approximately 1-60 seconds (preferably 10 seconds) for pump 1810 to fill the washing area 1630 with the fresh liquid from chamber 1512, (b) approximately 1-15 minutes (preferably 4 minutes) for motor 1900 to operate, and (c) approximately 1-60 seconds (preferably 20 seconds) for pump 1820 to drain the liquid into chamber 1522. The rinse cycle can include but is not limited to: (d) approximately 1-60 seconds (preferably 7 seconds) for pump 1810 to fill the washing area 1630 with the fresh liquid from chamber 1512, (e) approximately 1-15 minutes (preferably 2 minutes) for motor 1900 to operate, and (f) approximately 1-60 seconds (preferably 20 seconds) for pump 1820 to drain the liquid into chamber 1522. The second rinse cycle can include but is not limited to (g) approximately 1-60 seconds (preferably 11 seconds) for pump 1810 to fill the washing area 1630 with the fresh liquid from chamber 1512, (h) approximately 1-15 minutes (preferably 2 minutes) for motor 1900 to operate, and (i) approximately 1-60 seconds (preferably 20 seconds) for pump 1820 to drain the liquid into chamber 1522. The optional cycle, which can be included prior to, during, or after any of the aforementioned cycles, can include approximately 1-30 minutes (preferably 5 minutes) for motor 1900 to operate. The reset operation can include approximately 1 second up to 3 minutes (preferably 50 seconds) for pump 1810 to fill the washing area, and approximately 1 second up to 3 minutes (preferably 50 seconds) for pump 1820 to drain the liquid. After a cleaning cycle has completed, the stand 1400 can be slightly rotated or moved upward to disengage the brush bristles from the bristle disc 1600, thereby allowing the brushes to dry.

While specific embodiments have been shown and discussed, various modifications may of course be made, and the disclosure described herein is not limited to the specific forms or arrangement of parts described herein, except insofar as such limitations are included in the following claims. Further, it will be understood that certain features and sub-combinations are of utility and may be employed without reference to other features and sub-combinations. This is contemplated by and is within the scope of the claims.

What is claimed is:

1. A cosmetic brush cleaner apparatus, comprising:

a base;

a cleaning member plate having a textured surface, wherein the cleaning member plate is coupled to the base;

an upright column located at the center of the cleaning member plate, the column having a first tier and a second tier;

the first tier comprising a first brush holder and the second tier comprising a second brush holder, wherein the second brush holder is configured to secure a lower region of a cosmetic brush and the first brush holder configured to secure a higher region of the cosmetic brush in such a way that a plurality of bristles of the cosmetic brush are in direct contact with the cleaning member plate; and a motor coupled to the column, the motor located below the first and second tiers, and the motor being so configured as to rotate the column in a back and forth operation with respect to the cleaning member plate.

2. The cosmetic brush cleaner of claim 1, wherein the first tier is further comprised of a first disc and the second tier is further comprised of a second disc.

3. The cosmetic brush cleaner of claim 2, wherein the first and second plates further comprise a plurality of cosmetic brush securement members.

4. The cosmetic brush cleaner of claim 3, wherein the securement members are comprised of flexible openings configured to secure the cosmetic brushes.

5. The cosmetic brush cleaner of claim 1, wherein the base further comprises a fluid basin having a first compartment and a second compartment.

6. The cosmetic brush cleaner of claim 5, wherein the first compartment receives fresh fluid and the second compartment receives disposal fluid.

7. The cosmetic brush cleaner of claim 1, wherein the brush holder at least partially rotates with respect to the cleaning member.

8. The cosmetic brush cleaner of claim 1, wherein the brush cleaner further comprises a user interface controlling operation of the brush cleaner apparatus.

9. A cosmetic brush cleaner apparatus, comprising:

a removable lid;

a base;

a removable upright column located at the center of the base;

a drive shaft coupled to the upright column;

a brush holder coupled to the upright column, wherein the brush holder is comprised of a first tier plate having a plurality of brush securement members and a second tier plate having a plurality of brush securement members;

a cleaning disc having a textured surface;

a liquid dispensing port adjacent to the cleaning disc;

a liquid drainage port adjacent to the cleaning disc;

a step motor coupled to the drive shaft, wherein the step motor is below the brush holder; and a controller configured to operate the step motor of the brush cleaner, wherein the step motor and drive shaft are configured to rotate the brush holder in a clockwise and counter-clockwise operation.

10. The cosmetic brush cleaner of claim 9, wherein a first securement device secures a tail region of a cosmetic brush, and a second securement device secures a head region of the cosmetic brush.

11. A cosmetic brush cleaner apparatus, comprising:

a cleaning member plate having a textured surface;

an upright elongated member located in a middle region of the cleaning member plate, the upright elongated member having a first tier and a second tier, the second tier located above the first tier, wherein the first tier comprises a first brush holder and the second tier comprises a second brush holder;

an upright drive shaft coupled to the upright elongated member; and a motor coupled to the drive shaft, wherein the motor is below the first and second tiers.

12. The cosmetic brush cleaner of claim 11, wherein the motor is configured to rotate the brush holder in a back and forth operation.

* * * * *